US007976676B2

(12) United States Patent
Yin et al.

(10) Patent No.: US 7,976,676 B2
(45) **Date of Patent: *Jul. 12, 2011**

(54) PROCESS OF BLEACHING SOFTWOOD PULPS IN A D1 OR D2 STAGE IN A PRESENCE OF A WEAK BASE

(75) Inventors: Caifang Yin, Mason, OH (US); Kent Witherspoon, Killen, AL (US)

(73) Assignee: International Paper Company, Memphis, TN (US)

( * ) Notice: Subject to any disclaimer, the term of this patent is extended or adjusted under 35 U.S.C. 154(b) by 782 days.

This patent is subject to a terminal disclaimer.

(21) Appl. No.: 11/640,822

(22) Filed: Dec. 18, 2006

(65) Prior Publication Data

US 2008/0142174 A1 Jun. 19, 2008

(51) Int. Cl.
*D21C 9/14* (2006.01)

(52) U.S. Cl. ..... 162/67; 162/9; 162/74

(58) Field of Classification Search ..... 162/9, 67, 162/74

See application file for complete search history.

(56) References Cited

U.S. PATENT DOCUMENTS

| | | | | |
|---|---|---|---|---|
| 2,639,987 A | | 5/1953 | Sloman | |
| 3,657,065 A | | 4/1972 | Smith et al. | |
| RE28,777 E | * | 4/1976 | Wilder | 162/25 |
| 4,859,283 A | | 8/1989 | Jayawant | |
| 5,091,054 A | | 2/1992 | Meier et al. | |
| 5,179,021 A | | 1/1993 | du Manoir et al. | |
| 5,441,603 A | | 8/1995 | Griggs et al. | |
| 5,641,385 A | | 6/1997 | Croft et al. | |
| 5,681,427 A | | 10/1997 | Lora et al. | |
| 5,902,454 A | | 5/1999 | Nelson | |
| 6,056,853 A | | 5/2000 | Vincent et al. | |
| 6,235,154 B1 | * | 5/2001 | Jiang et al. | 162/65 |
| 6,245,196 B1 | | 6/2001 | Martin et al. | |
| 6,258,208 B1 | | 7/2001 | Lindeberg et al. | |
| 6,398,908 B1 | | 6/2002 | Hermansson et al. | |
| 6,464,832 B2 | | 10/2002 | Engelhardt et al. | |

(Continued)

FOREIGN PATENT DOCUMENTS

CA 756967 A * 4/1967

(Continued)

OTHER PUBLICATIONS

Environmental Defense Fund et al., Economics of Kraft Pulping and Bleaching, 1995, Paper Task Force, p. 49-51.*

(Continued)

*Primary Examiner* — Matthew J Daniels
*Assistant Examiner* — Anthony Calandra
(74) *Attorney, Agent, or Firm* — Thomas W. Barnes, III; Eric W. Guttag; Matthew M. Eskami

(57) ABSTRACT

This invention relates to an improved bleaching process for bleaching pulp comprising at least one bleaching stage which comprises treating a softwood pulp with a bleaching agent comprising $ClO_2$ in the presence of a weak base such as, for example, $Mg(OH)_2$ preferably at pH from about 3.5 to about 6.5. The invention is also relates a bleaching process for bleaching pulp having two or more bleaching stages, at least one of which and preferably two of which comprises treating a softwood pulp with a bleaching agent comprising $ClO_2$ in the presence of a weak base such as, for example, $Mg(OH)_2$ preferably at pH from about 3.5 to about 6.5.

20 Claims, 2 Drawing Sheets

U.S. PATENT DOCUMENTS

| | | | | |
|---|---|---|---|---|
| 6,569,284 | B1 | 5/2003 | Yin et al. | |
| 2001/0050153 | A1 | 12/2001 | Wajer et al. | |
| 2002/0189021 | A1 | 12/2002 | Haynes et al. | |
| 2003/0145961 | A1 | 8/2003 | Rousu et al. | |
| 2004/0112555 | A1 | 6/2004 | Tolan et al. | |
| 2004/0112557 | A1 | 6/2004 | Parrish et al. | |
| 2004/0149404 | A1 * | 8/2004 | Snekkenes et al. | 162/60 |
| 2007/0079944 | A1 * | 4/2007 | Amidon et al. | 162/72 |

FOREIGN PATENT DOCUMENTS

| | | | | |
|---|---|---|---|---|
| EP | 0716182 | | | 11/1995 |
| GB | 815247 | A | * | 6/1959 |
| GB | 1505076 | | | 3/1978 |
| JP | 2004124265 | A | * | 4/2004 |
| WO | WO 88/01661 | | | 3/1988 |
| WO | WO 02/075046 | | | 9/2002 |
| WO | WO 03/074780 | | | 9/2003 |
| WO | WO 2004/079087 | | | 9/2004 |
| WO | WO 2006/121634 | | | 11/2006 |

OTHER PUBLICATIONS

Martin Marietta Materials, Martin Marietta Magnesia Specialties [downloaded online from: www.magnesiaspecialties.com], 2008 [downloaded online Sep. 3, 2009], whole document.*

English Machine Translation of JP 2004124265A, Apr. 2004.*

Gullichsen et al., Chemical Pulping 6A, 1999, Fapet Oy, p. A616-A665.*

Kolar, Chemical Reactions in Chlorine Dioixde Stages of Pulp Bleaching, 1983, Wood Science and technology, 17, p. 117-228.*

* cited by examiner

Fig. 2- Effect of D1 pH and Caustic Source on D1 Brightness - Softwood Pulp
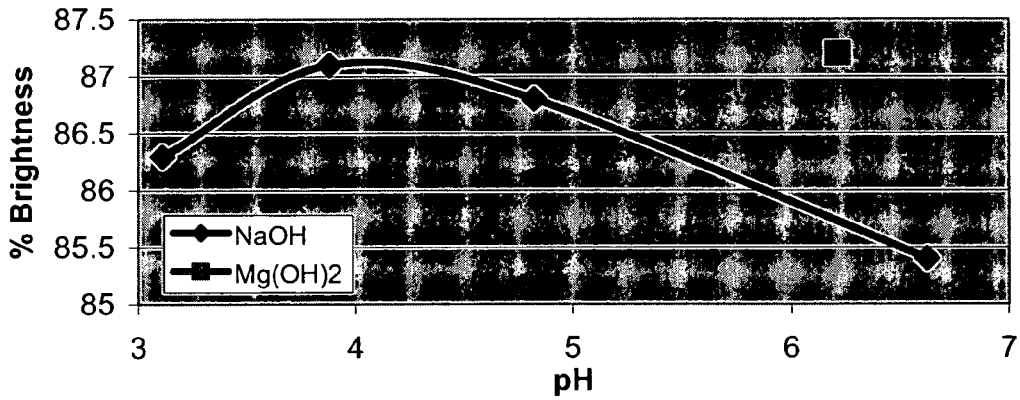

PROCESS OF BLEACHING SOFTWOOD PULPS IN A D1 OR D2 STAGE IN A PRESENCE OF A WEAK BASE

FIELD OF THE INVENTION

This invention relates to the bleaching of softwood pulp. More particularly, the invention relates to improvements of bleaching a pulp in D stage bleaching in presence of $Mg(OH)_2$.

BACKGROUND OF THE INVENTION

The bleaching pH plays a key role in $ClO_2$ bleaching/brightening in the D1 and D2 stages. Our current understanding of optimum $ClO_2$ bleaching pH is largely credited to the earlier work done by Raspon in 1956. Studying on Eastern Canadian softwood kraft pulp at kappa 28 with conventional chlorine based bleaching, Rapson showed an optimum D1 stage of 3.8 for maximum brightness. The maximum brightness corresponds to the minimum formation of two unproductive products, chlorite and chlorate, during $ClO_2$ bleaching. Mill practice usually controls the D1 end pH at 3-3.5, a compromise between brightness development and dirt bleaching. In the absence of a dirt bleaching requirement, a mill usually controls the D2 pH at 4-4.5. Mills make no distinction between optimum bleaching pH requirements for SW or HW pulp. While these pHs are largely true for softwood pulp, the optimum bleaching pHs for hardwood species are much higher than 3.8 recommended by Rapson.

SUMMARY OF THE INVENTION

One aspect of this invention relates to an improved bleaching process for bleaching pulp comprising at least one bleaching stage which comprises treating a softwood pulp with a bleaching agent comprising $ClO_2$ in the presence of a weak base such as, for example, $Mg(OH)_2$ preferably at pH from about 3.5 to about 6.5.

Another aspect of this invention relates to an improved bleaching process comprising at least one extraction stage and at least one bleaching stage wherein the least one bleaching stage comprises bleaching a softwood pulp with a bleaching agent comprising $ClO_2$ in the presence of a weak base, as for example, $Mg(OH)_2$ preferably at pH of about 3.5 to about 6.5.

A further aspect of the present invention relates to an improved bleaching process for bleaching pulp having two or more bleaching stages, at least one of which and preferably two of which comprises treating a softwood pulp with a bleaching agent comprising $ClO_2$ in the presence of a weak base such as $Mg(OH)_2$.

Yet another aspect of this invention relates to an improved bleaching process for bleaching pulp comprising a bleaching sequence selected from the group consisting of the formula:

Three-stage bleaching sequence: $D_oED_1$ where E can be E, Eo, Ep, or Eop

Four-stage bleaching sequence: $D_oED_1D_2$ where E can be E, Eo, Ep, or Eop

Four-stage bleaching sequence: $D_oED_1P$ where E can be E, Eo, Ep, or Eop

Five-stage bleaching sequence: $D_oE_1D_1E_2D_2$ where $E_1$ can be E, Ea, Ep, or Eop and $E_2$ can be Ep with interstage washing and wherein:

D is a stage in which a pulp is treated with a bleaching agent comprising $ClO_2$. The first $D_o$ stage is a delignification stage.

The second and third $D_1$ and $D_2$ stages are the bleaching stages comprising $ClO_2$ in the presence of $Mg(OH)_2$ at pH from about 15 to about 6.5.

E is an extraction stage, where E can be E, Eo, Ep, Eop. The extraction stage Eo is defined as treating the pulp with oxygen in presence of a base. The extraction stage E is defined as treating the pulp in the presence of a base. The extraction stage Ep is defined as treating the pulp with peroxide in presence of a base. The extraction stage Eop is defined as treating the pulp with oxygen and peroxide in presence of a base.

The process of the present invention provides one or more advantages over prior processes for brightening bleached pulps. For example, advantages of some of the embodiments of the process of this invention include 1) improve bleaching efficiency which is defined as brightness development per unit of $ClO_2$, 2) reducing the bleaching cost, 3) high pulp brightness and brightness stability, 4) improve pulp cleanliness, 5) a combination of two or more of the aforementioned advantages. $Mg(OH)_2$ is more effective than NaOH in raising D1 pH and gives better results in both brightness development and dirt removal in the D1 stage at the same pH basis. Unlike NaOH, $Mg(OH)_2$ is a weaker base and provides a pH buffer effect, which helps pH uniformity and stability in the D1 tower compared with NaOH. The ability of $Mg(OH)_2$ to achieve a higher pH and better pH uniformity and stability than NaOH is the basis for the improved D1 performance with $Mg(OH)_2$.

Some embodiments of this invention may exhibit one of the aforementioned advantages while other preferred embodiments may exhibit two or more of the foregoing advantages in any combination.

BRIEF DESCRIPTION OF THE DRAWINGS

A full understanding of the invention can be gained from the following description of the preferred embodiments when read in conjunction with the accompanying drawings in which:

FIG. 2 is a graph showing the effect of D1 pH and caustic source on D1 Brightness for softwood pulp.

DETAILED DESCRIPTION OF THE INVENTION

Figure 1:
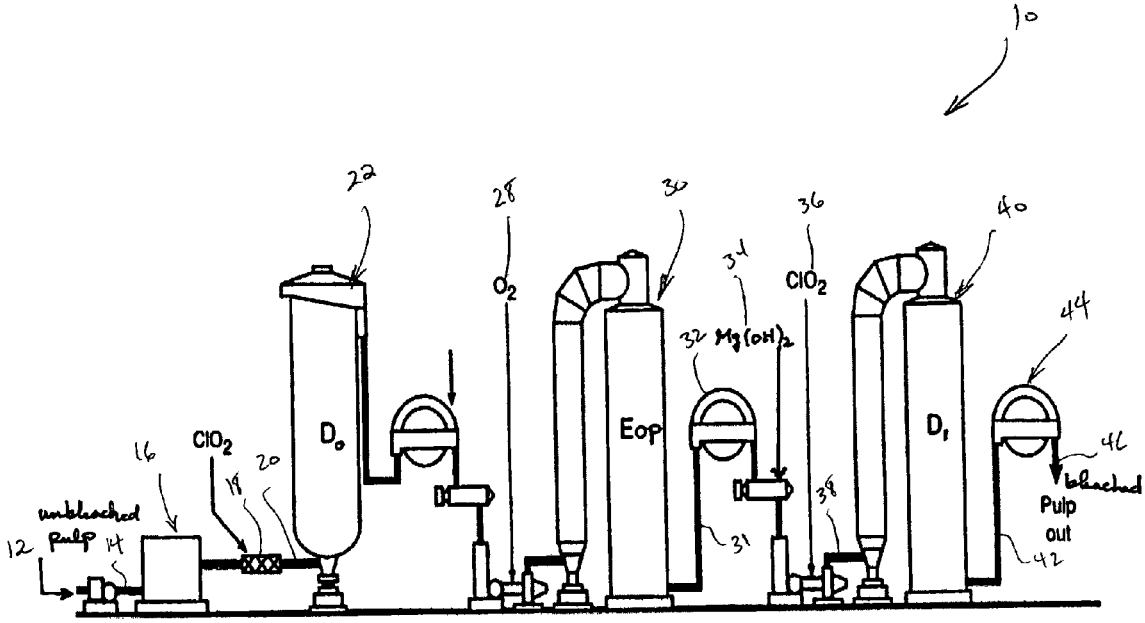
FIG. 1 is a schematic illustration of the overall pulp making in accordance to the present invention.

While this invention is susceptible of embodiment in many different forms, there is shown and described in drawing, figures, and examples and will herein be described in detail preferred embodiments of the invention with the understanding that the present disclosure is to be considered as an exemplification of the principles of the invention and is not intended to limit the broad aspect of the invention to the embodiments illustrated.

One aspect of this invention relates to an improved bleaching process for bleaching pulp comprising at least one (D) bleaching stage which comprises treating a softwood pulp with a bleaching agent comprising $ClO_2$ in the presence of a weak base, for example, $Mg(OH)_2$ preferably at pH from about 3.5 to about 6.5.

The pH of the at least one (D) bleaching stage is in the range from greater than 3 to about 6.5. Any pH within this range can be used. For example, the pH can be as high as about 6 or 6.5 and as low as about 3 to about 3.5. In the preferred embodiments of the invention, the pH is from about 3 to about 5. In the more preferred embodiments of the invention, the pH is from about 3.5 to about 4.5 and in the most preferred embodiments of the invention, the pH is from about 4.0 to about 4.5.

In the preferred embodiment of this invention, the pH in the at least one (D) bleaching stage of the present invention is higher than the pH of the conventional D bleaching stage. The advantages of higher pH are higher bleaching efficiency, higher dirt removal efficiency, and higher brightness, less reverted brightness which means higher brightness stability or a combination of two or more thereof.

A weak base is used in the at least one bleaching stage to control pH. As used herein, a weak base is defined as a chemical base in which protonation is incomplete. This result in a relatively low pH level compared to strong bases. While we do not wish to be bound by any theory, it is believed that the weak base is any compound that can continuously supply basic species, such as ($OH^-$) to neutralize the protons ($H^+$) produced in organic reactions such as pulp bleaching to buffer the pH at a relatively constant value or within a narrow range.

Illustrative of the weak bases that can be used in the presence of this invention are $NaH_2PO_3$, $Ca(OH)_2$, $NH_4OH$, $NaHCO_3$, $HOCCH_3$ and $Mg(OH)_2$. $Mg(OH)_2$ is a preferred weak base because in addition to its partial dissociation to release base (OH—), partial solubility of $Mg(OH)_2$ allows continuously solubilizing $Mg(OH)_2$ in response to the produced acids or protons in bleaching reactions as the $Mg(OH)_2$ solubility increases with the decrease in solution pH.

The amount and type of weak base used is dictated by the target pH at the end of bleaching reaction.

The bleaching agent used in the process of this invention comprises $ClO_2$. The bleaching agent may include other ingredients in admixture with the $ClO_2$, for example, elemental chlorine and inert gases such as air.

The amount of $ClO_2$ used in the at least one bleaching stage can vary widely and is an amount sufficient to bleach the softwood pulp to the desired brightness. The amount of $ClO_2$ is typically equal to or greater than about 0.1% based on the total weight of pulp (an oven dried basis), preferably the amount of $ClO_2$ is from about 0.2% to about 1% and more preferably the amount of $ClO_2$ is from about 0.2% to about 0.8%, and most preferably the amount of $ClO_2$ is from about 0.3% to about 0.5%.

The consistency (CSC) of the at least one bleaching stage of the pulp may vary widely and any consistency that provides the desired increase in pulp brightness may be used. The pulp may be bleached under low consistency conditions (i.e. from about 3 to about 4 based on the total weight of the mixture of pulp and bleaching chemicals), medium consistency conditions (i.e. from about 8% to about 14% based on the total weight of the mixture of pulp and bleaching chemicals) or high consistency conditions (i.e. from about 25 to about 30 based on the total weight of the mixture of pulp and bleaching chemicals). The consistency is preferably from about 5 to 15, more preferably from about 8 to 15, and most preferably from about 10% to about 12%.

The retention times of the at least one bleaching stage of pulp will vary widely and times used in conventional bleaching stages may be used. Usually, retention times will be at least about 180 minutes. Retention times are preferably from about 60 min. to about 240 min., and are more preferably from about 120 minutes to about 200 min. and most preferably from about 150 min. to about 180 min.

Similarly, the bleaching temperatures employed in the at least one bleaching stage of the pulp may vary widely and temperatures employed in conventional bleaching stages may be used. For example, useful temperatures can be as low as about 55° C. or lower and as high as about 85° C. or higher. In the process of this invention, the bleaching temperature is usually from about 60° C. to about 80° C., preferably from about 60° C. to about 75° C., more preferably from about 65° C. to about 75° C. and most preferably from about 65° C. to about 70° C.

However, one of the advantages of a preferred embodiment of this invention is the enhanced bleaching efficiency in the at least one bleaching stage. The bleaching efficiency is defined as brightness developed per unit $ClO_2$. The bleaching efficiency of the preferred embodiment of this invention is preferably at least about 0.3, more preferably at least about 0.35, and most preferably at least about 0.37. The bleaching efficiency of the preferred embodiment is greater than that of the same or substantially the same bleaching processes in which NaOH is used in the at least one bleaching rather than $Mg(OH)_2$.

Another advantage a preferred embodiment of this invention is the reduction of dirt resulting from the at least one bleaching stage as compared to the same or substantially the same bleaching processes which do not include the $Mg(OH)_2$. For example, the amount of dirt is typically at least about 0.1%, preferably at least about 0.1%, more preferably at least about 0.015% and most preferably at least about 0.012% less compared to the amount of dirt produced in the same or substantially the same bleaching processes which do not include the $Mg(OH)_2$ to obtain the same or substantially the same level of pulp brightness in the Eop and/or Ep stages.

In addition, the pulp brightness and viscosity were higher than those treatments with NaOH, which indicates the positive impact of $Mg(OH)_2$ used in treatment, on the bleaching efficiency. For example, the viscosity is typically at least about 1.5%, preferably at least about 2%, more preferably at least about 2.5% and most preferably at least about 3% greater than the viscosity of the pulp made by the same or substantially the same bleaching processes which do not include $Mg(OH)_2$. For example, the brightness is typically at least about 0.5 brightness points, preferably at least about 0.75 brightness points, more preferably from about 1.0 and most preferably at least about 1.5 greater than the brightness of the pulp made by the same or substantially the same bleaching processes which do not include the $Mg(OH)_2$.

In the preferred embodiment of this invention, the bleaching process will also comprise at least one extraction stage prior to the at least one bleaching stage.

Conventional process parameters employed in these extraction stages are well known in the art as for example "Pulp Bleaching Principles and Practice of Pulp Bleaching" Carlton W. Dence and Douglas W. Reeve, TAPPI Press, 1996 and references cited therein. Accordingly, they will not be described in greater detail.

However, one of the advantages of a preferred embodiment of this invention is the reduction of bleaching chemicals such as $ClO_2$ in the D stage as compared to the same or substantially the same bleaching processes which do not include $Mg(OH)_2$. For example, the amount of $ClO_2$ is typically at least about 5%, preferably at least about 10%, more preferably from about 15% to about 50% and most preferably from about 20% to about 25% less compared to the amount of $ClO_2$ used in the same or substantially the same bleaching processes which do not include $Mg(OH)_2$ to obtain the same or substantially the same level of pulp brightness in the Eop and or Ep stages.

Another advantage of a preferred embodiment of this invention is the reduction of the amount of the Dirt count resulting from the at least on bleaching stage as compared to the same or substantially the same bleaching processes which do not include the $Mg(OH)_2$. For example, the amount of the Dirt count is typically at least about 4%, preferably at least about 5%, more preferably from about 7% to about 20% and most preferably from about 8% to about 15% less compared to the amount of the Dirt count produced in the same or substantially the same bleaching processes which do not include the $Mg(OH)_2$ to obtain the same or substantially level of pulp brightness in the Do stage.

Another aspect of this invention relates to an improved bleaching process comprising at least one extraction stage and at least one bleaching stage wherein the least one bleaching stage comprises bleaching a softwood pulp with a bleaching agent comprising $ClO_2$ in the presence of a weak base, as for example, $Mg(OH)_2$ preferably at pH of about 3.5 to about 6.5.

The at least one extraction stage is carried out prior to the at least one bleaching stage and any type of extraction or delignification can be used. In the preferred embodiment of the invention the extraction stage is carried out in a $D_o$ stage, E stage, Eo stage, Ep stage, and Eop stage or combination thereof, where $D_o$, Eo, Ep, Eop, are defined above. Conventional processes and apparatus can be used in the $D_o$, E, Eo, Ep, or Eop stage. See for example "Pulp Bleaching Principles and Practice of Pulp Bleaching" Carlton W. Dence and Douglas W. Reeve, TAPPI Press, 1996 and references cited therein. In the most preferred embodiment of the invention, the pulp is extracted in a $D_o$ stage and a Eop stage.

In addition to the at least one bleaching stage and the extraction stage, the process can also include one or more additional stages. Such a bleaching sequence include $D_oEopD_o$, $OD_oEopD_o$, $D_oEopD_1D_2$, $OD_oEopD_1D_2$, $D_oEopD_1EpD_2$, $OD_oEopD_1EpD_2$, $D_oEopD_1P$, $O(D_o/C)EopD_1$, $D_oEopD_1$, $D_oEopD_1$, $D_oEopED_1$, $D_oED_1EpEopD_2$, $ZED_oEop$, $ZD_oEopD_1$, $D_oEpZEop$, $D_oEpZD_1Z$, $D_oD_1EopPP$, $D_oD_1EopZ$, $D_oEopD_1$, $OD_oEopD_1$, $D_oEopD_1$, $OD_oEopD_1$, $D_oEopD_1EpD_2$, $OD_oEopD_1EpD_2$, $DEopD_1P$ and the like in which $D_o$, $D_1$, $D_2$, Eo, E, Ep and Eop are is as described above and Z is ozone, O is oxygen, P is peroxide, DIC is a mixture of chlorine dioxide and elemental chlorine and two or more symbols in parenthesis indicate an absence of an intermediate washing stage. The processes and apparatus used in the D, Z, E, Eo, Ep, Eop, O, P, DIC are conventional and therefore are well known in art. See for example, "Pulp Bleaching Principles and Practice of Pulp Bleaching" Carlton W. Dence and Douglas W. Reeve, TAPPI Press, 1996 and references cited therein.

The amount of extraction agent used (e.g. potassium hydroxide, etc.) used in the practice of the process of this invention can vary widely and any amount sufficient to provide the desired lignin extraction efficiency and the desired degree of brightness can be used. The amount of extraction agent used is usually at least about 0.1% based on the dry weight of the pulp. Preferably the amount of extraction agent is from about 0.2% to about 0.5%, more preferably from about 0.15% to about 0.35% and most preferably about 0.25% on the aforementioned basis.

The plant source of softwood pulp for use in this invention is not critical provided that it forms softwood pulp, and may be any fibrous plant which can be subjected to chemical pulp bleaching. Examples of such fibrous plants are softwood fibrous trees such as spruce, pine, cedar, including mixtures thereof. In certain embodiments, at least a portion of the pulp fibers may be provided from non-woody herbaceous plants including, but not limited to, kenaf, hemp, jute, flax, sisal, or abaca although legal restrictions and other considerations may make the utilization of hemp and other fiber sources impractical or impossible. The source of pulp for use in the practice of this invention is softwood fibrous trees such as spruce, pine, cedar, including mixtures thereof.

The pulp used in the process of this invention can be obtained by subjecting the fibrous plant to any chemical pulping process. Following the wood digestion process, pulp is separated from the spent pulping liquor. The spent pulping liquor is then recovered and regenerated for recycling. The pulp is then bleached and purified in a bleach plant operation.

The pulp of this invention can also be used in the manufacture of paper and packaging products such as printing, writing, publication and cover papers and paperboard products. Illustrative of these products and processes for their manufacture are those described in U.S. Pat. Nos. 5,902,454 and 6,464,832.

For example, in the paper or paperboard making process, the bleached pulp of this invention or pulp mixtures comprising the bleached pulp of this invention is formulated into an aqueous paper making stock furnish which also comprises one of more additives which impart or enhance specific sheet properties or which control other process parameters. Illustrative of such additives is alum which is used to control pH, fix additives onto pulp fibers and improve retention of the pulp fibers on the paper making machine. Other aluminum based chemicals which may be added to furnish are sodium aluminate, poly aluminum silicate sulfate and poly aluminum chloride. Other wet end chemicals which may be included in the paper making stock furnish for conventional purposes are acid and bases, sizing agents, dry-strength resins, wet strength resins, fillers, coloring materials, retention aids, fiber flocculants, defoamers, drainage aids, optical brighteners, pitch control chemicals, slimicides, biocides, specialty chemicals such as corrosion inhibitors, flame proofing and anti-tarnish chemicals, and the like.

The aqueous paper making stock furnish comprising the bleached pulp and the aluminum based compounds is deposited onto the forming wire of a conventional paper making machine to form a wet deposited web of paper or paperboard and the wet deposited web of paper or paperboard is dried to form a dried web of paper or paperboard. Paper making machines and the use of same to make paper are well known in the art and will not be described in any great detail. See for example, *Pulp and Paper Chemistry and Handbook for Pulp & Paper Technologies*, supra. By way of example, the aqueous paper making stock furnish containing pulp, aluminum based and other optional additives and usually having a consistency of from about 0.3% to about 1% is deposited from the head box of a suitable paper making machine as for example a twin or single wire Fourdrinier machine. The deposited paper making stock furnish is dewatered by vacuum in the forming section. The dewatered furnish is conveyed from the forming section to the press section on specially-constructed felts through a series of roll press nips which removes water and consolidates the wet web of paper and thereafter to the dryer section where the wet web of paper is dried to form the dried web of paper of this invention. After drying, the dried web of paper may be optionally subjected to several dry end operations such as and various surface treatments such as coating, and sizing and calendering.

The paper manufactured in accordance with this invention can be used for conventional purposes. For example, the paper is useful as printing paper, publication paper, newsprint and the like.

The present invention is described in more detail by referring to the following examples and comparative examples which are intended to more practically illustrate the invention and not to be a limitation thereon.

Example 1

FIG. 1 illustrates a portion of a bleach plant 10 that is used to produce bleached pulp in accordance with the preferred embodiment of the invention. The unbleached pulp 12 is conveyed to a low density chest 14 via line 16. In the low density chest 14, the unbleached pulp 12 is further diluted with water and then the pulp is mixed with $ClO_2$ in the mixer 18 before the pulp 12 is transferred to Do delignification 22 tower via line 20. In the Do delignification 22 tower, lignin is oxidized and then the pulp 12 is transferred to washer 24 via lines 26 to remove oxidized lignin and inorganic materials. After the last Do washing stage 28, the pulp preferably has a consistency of from about 8% to about 15%. The pulp 12 is then transferred to the extraction with peroxide (Eop). After, the Eop stage, the pulp 12 can be stored in a storage tank (not depicted) until required for the first acidic bleaching stage 40. In the preferred embodiment of the invention, the pulp 12 is transferred to a second washer 32 via line 31. After the second washer 32, $Mg(OH)_2$ is added to the pulp before the pulp is transferred to a first acidic bleaching stage 40. In first acidic bleaching stage 40, the pulp 12 is bleached under acidic conditions with a bleaching agent comprising chlorine dioxide. In the preferred embodiments of the invention as depicted in the FIG. 1, the bleaching agent is chlorine dioxide comprising less than about 1.5%, preferably less than about 1%, more preferably less than about 0.5% and most preferably less than about 0.3% of the active bleaching agent is elemental chlorine. In the embodiments of the invention of choice, the active bleaching agent is chlorine dioxide which contains no or substantially no elemental chlorine (i.e. less than about 1% to about 5%). The application rates, pHs, times and temperatures used in the acidic bleaching stage may vary widely and any known to the art can be used.

The bleached pulp 12 is conveyed via line 42 to at least one post first acidic bleaching stage washer or decker 44.

The final pH of the first acidic bleaching stage is critical for the advantages of this invention. The pH is greater than 3.5 and is preferably equal to or greater than about 6.5. In the preferred embodiments of this invention, the end point pH is from about 3.0 to about 5.0 and in the most preferred embodiments of the invention is from about 4.0 to about 4.5.

The pulp can be processed from system and used for conventional purposes or the pulp can be subjected to one or more additional acidic and/or alkaline bleaching stages either before or after the first acidic bleaching, alkaline bleaching stage and/or second acidic bleaching stage. As for example, further pulp bleaching with one or more bleaching agents selected from the group consisting of peroxide, chlorine dioxide and ozone. Such additional bleaching stages may be without subsequent washing or may be followed by subsequent wash stage or stage(s). As depicted in FIG. 1, pulp can be conveyed from stage 40 via line 42 to at the post acidic bleaching washing stage 44 where the pulp is washed. The washed pulp exits the bleaching sequence via line 46 for conventional use as for example in a paper making process.

Example 2

The pulp was made from a pine softwood cooked by the Kraft process. The unbleached Eop pulp had 4.9 Permanganate number, 52.2% brightness, and 25 cP viscosity. The procedure for Permanganate or P number, brightness, and viscosity are shown below.

Bleaching was conducted in sealed plastic bags. All pulp samples were preheated to the bleaching temperature, and all the chemicals were added sequentially and mixed thoroughly with the pulp before addition of another chemical. The chemical addition sequence in the D stages are deionized water, caustic (for pH control), and $ClO_2$.

After completing the $D_1$ bleaching stage, the pulp was squeezed to collect filtrate for pH, residual, and COD measurement. The pulp was repulped at 1% consistency with deionized water and dewatered on a Buchner funnel and repeat a couple of time to simulate a pulp washing stage in mills. The washed pulp was analyzed for brightness, viscosity, and pulp dirt. The procedures are set forth below:

Brightness

Approximately 5 grams of pulp is rolled or pressed on a disc and is permitted to completely dry. The brightness is measured on both sides of the brightness pad, at least four readings per side and then the average is calculated. These readings are performed on a GE brightness meter which reads a directional brightness or on an ISO brightness meter which reads a diffused brightness. Both instruments are made by Technidyne Corp.

Reverted Brightness

Reverted brightness, a standard lab test for pulp brightness stability, was conducted by placing the pulp brightness pad (after brightness reading) in an oven at 105 C for 60 min. After that, the brightness pad is read for brightness as reverted brightness.

Viscosity

The viscosity is a measurement used to compare a relative strength property of the pulp. This property is used to determine the percentage of hardwood/softwood for making different grades of paper. A Cannon-Fenske (200) viscometer tube, calibrated for 25 C, is used for testing bleached pulps. The sample size is 0.2000 grams, using 20 ml, 1.0 molar CED and 20 ml DI water mixed thoroughly to break down the pulp fiber.

Permanganate Number

The Permanganate Number indicates the amount of lignin that is in the pulp. (The Kappa number is generally used only on the brownstock, while the value for the Permanganate Number is comparative to the bleached pulp.) The procedure for determining the Permanganate Number is:

1. Weigh exactly 1.00 gram sample.
2. Put the sample in a blender with 700 ml DI water and blend about 45 seconds, pour the sample into a battery jar on a stir plate.
3. Add exactly 25 ml of 0.1 N Potassium Permanganate and 25 ml 4N $H_2SO_4$, starting a timer set for 5 min.
4. When the timer stops, add 6 ml 1 Molar KI and allow it to mix thoroughly to kill the reaction.
5. Titrate to a starch end point with 0.1N Sodium Thiosulfate. Record mls titrated.
6. In 700 ml DI water without the pulp sample, use the same reagents and titrate to use as a blank. Using an accurately prepared Potassium Permanganate, the blank should be 25.0
7. Subtract the mls titrated with the sample from the mls titrated for the blank and the result will be the P Number.

Dirt

Pulp dirt count is done by a visual count of all the dirt spots on the brightness pad and is the size weighted sum of the total dirt spots according to a Tappi temperature rate.

All the filtrate and pulp analysis was done with the standard published procedures understood by all the people working in the field. The lab D1 bleaching was conducted at 0.8% $ClO_2$ and 60° C. for 150 min.

The results are shown in Table 1 and FIG. 2.

TABLE 1

Effect of pH and Caustic Source on D1 Brightness
Mill A Pine Pulp

| Caustic Source | | | NaOH | | $Mg(OH)_2$ |
|---|---|---|---|---|---|
| Caustic charge, % | 0 | 0.1 | 0.2 | 0.3 | 0.1 |
| D1 pH | 3.11 | 3.88 | 4.82 | 6.62 | 6.21 |
| D1 $ClO_2$ residual, % | 0.02 | 0.015 | 0.034 | 0.184 | 0.136 |
| D1 brightness, % | 86.3 | 87.1 | 86.8 | 85.4 | 87.2 |
| D1 Viscosity, cPs | 14 | 13.9 | 13.8 | 13.0 | 13.9 |
| D1 Dirt, ppm | 0.04 | 0.05 | 0 | 0 | 0 |

Example 3

Using the process and the pulp of Example 2, $Mg(OH)_2$ was substituted for NaOH, and brightness, viscosity, dirt were determined using the procedure in Example 2.

The results are summarized in Table 2.

TABLE 2

Effect of $D_1$ pH and Caustic Source on Bleachability
Androscoggin Softwood Eop Pulp

| Caustic Source | | NaOH | | $Mg(OH)_2$ |
|---|---|---|---|---|
| Caustic, % | 0.2 | 0.3 | 0.4 | 0.25 |
| $ClO_2$ residual, gpl | 0.01 | 0.05 | 0.09 | 0.2 |
| pH | 3.2 | 3.94 | 4.75 | 4.15 |
| Brightness, % | 84.7 | 84.7 | 84.3 | 86.0 |
| Reverted Brightness, % | 82.5 | 82.6 | 82.1 | 84.2 |
| Tappi Dirt, ppm | 0 | 0 | 0 | 0 |
| Viscosity, cPs | 21 | 20 | 18.7 | 20.2 |

Various modifications and variations may be devised given the above-described embodiments of the invention. It is intended that all embodiments and modifications and variations thereof be included within the scope of the invention as it is defined in the following claims.

What is claimed is:

1. An improved bleaching process for bleaching pulp comprising:

at least one $D_1$ or $D_2$ bleaching stage which comprises treating a softwood pulp solely with a bleaching agent which is selected from the group consisting of chlorine dioxide and chlorine dioxide with less than about 1.5% elemental chlorine in the presence of a weak base which is selected from the group consisting of $NaH_2PO_3$ and $NH_4OH$ at a pH of from about 3.5 to about 6.5.

2. The bleaching process of claim 1 wherein the weak base is added after a washer before the $D_1$ stage.

3. The bleaching process of claim 1 wherein the pulp pH is from about 3.5 to about 4.5.

4. The bleaching process of claim 1 wherein the pulp consistency is from about 10% to about 20%.

5. The bleaching process of claim 1 wherein the retention time is from about 10 min. to about 300 min.

6. The bleaching process of claim 1 wherein the temperature is from about 55° C. to about 85° C.

7. The bleaching process of claim 1 wherein the amount of chlorine dioxide used in the at least one $D_1$ or $D_2$ bleaching stage is from about 0.1% to about 0.5%.

8. The bleaching process of claim 1 further comprising at least one extraction stage carried out in a E stage, a Eo stage, a Ep stage, or a Eop stage or a combination thereof.

9. The bleaching process of claim 8 having a bleaching sequence selected from the group consisting of $D_oEopD_1D_2$, $OD_oEopD_1D_2$, $D_oEopD_1EpD_2$, $OD_oEopD_1EpD_2$, $D_oEopD_1P$, $O(D_o/C)EopD_1$, $D_oEopD_1$, $D_oEopD_1$, $D_oEopED_1$, $D_oED_1EpEopD_2$, $ZD_oEopD_1$, $D_oEpZD_1Z$, $D_oD_1EopPP$, $D_oD_1EopZ$, $D_oEopD_1$, $OD_oEopD_1$, $D_oEopD_1$, $OD_oEopD_1$, $D_oEopD_1EpD_2$, $OD_oEopD_1EpD_2$, and $DEopD_1P$, wherein E, Eo, Ep, Eop, Z, O are defined as: Eo is defined as treating the pulp with oxygen in presence of a base, E is defined as treating the pulp in the presence of a base, Ep is defined as treating the pulp with peroxide in presence of a base, Eop is defined as treating the pulp with oxygen and peroxide in presence of a base, Z is ozone, and O is Oxygen.

10. The bleaching process of claim 9, wherein the bleaching sequence is selected from the group consisting of $D_oEopD_1D_2$, $D_oEopD_1EpD_2$, $D_oEopD_1P$, $D_oEopD_1$, $D_oEopD_1$, $D_oEopED_1$, $D_oED_1EpEopD_2$, $ZD_oEopD_1D_1$, $D_oEpZD_1Z$, $D_oD_1EopPP$, $D_oD_1EopZ$, $D_oEopD_1$, $D_oEopD_1$, and $D_oEopD_1EpD_2$.

11. The bleaching process of claim 1, wherein the bleaching agent is chlorine dioxide with less than about 1.5% elemental chlorine.

12. An improved bleaching process for bleaching pulp comprising:

at least one extraction stage and at least one bleaching stage wherein the least one $D_1$ or $D_2$ bleaching stage comprises bleaching a softwood pulp solely with a bleaching agent which is selected from the group consisting of chlorine dioxide and chlorine dioxide with less than about 1.5% elemental chlorine in the presence of a weak base which is selected from the group consisting of $NaH_2PO_3$ and $NH_4OH$ at a pH of from about 3.5 to about 6.5.

13. The bleaching process of claim 12 wherein the weak base is added after a washer before the $D_1$ stage.

14. An improved bleaching process for bleaching pulp having two or more bleaching stages, at least one of which is a $D_1$ or $D_2$ bleaching stage which comprises treating a softwood pulp solely with a bleaching agent which is selected from the group consisting of chlorine dioxide and chlorine dioxide with less than about 1.5% elemental chlorine in the presence of a weak base which is selected from the group consisting of $NaH_2PO_3$ and $NH_4OH$ at a pH of from about 3.5 to about 6.5.

15. The bleaching process of claim 14 wherein the weak base is added after a washer before the $D_1$ stage.

16. The bleaching process of claim 15 wherein the pulp pH is from about 3.5 to about 4.5.

17. An improved bleaching process for bleaching pulp comprising:

at least one $D_1$ or $D_2$ bleaching stage which comprises treating a softwood pulp solely with a bleaching agent comprising chlorine dioxide in the presence of a weak base at a pH of from about 3 to about 5, wherein the amount of chlorine dioxide used in the at least one bleaching stage is from about 0.1% to about 0.5% and wherein the weak base is $NH_4OH$.

18. The bleaching process of claim 17 wherein the pulp pH is from about 3.5 to about 4.5.

19. The bleaching process of claim 17, wherein the bleaching agent comprises less than about 1.5% elemental chlorine.

20. An improved bleaching process for bleaching pulp comprising:

at least one $D_1$ or $D_2$ bleaching stage which comprises treating, in the absence of oxygen, a softwood pulp with a bleaching agent which is selected from the group consisting of chlorine dioxide and chlorine dioxide with less than about 1.5% elemental chlorine in the presence of a weak base which is selected from the group consisting of $NaH_2PO_3$ and $NH_4OH$ at a pH of from about 3.5 to about 6.5.

* * * * *